US005542354A

United States Patent [19]

Sigler

[11] Patent Number: 5,542,354

[45] Date of Patent: Aug. 6, 1996

[54] SEGMENTING WARHEAD PROJECTILE

[75] Inventor: John W. Sigler, La Mirada, Calif.

[73] Assignee: Olin Corporation, Downey, Calif.

[21] Appl. No.: 492,460

[22] Filed: Jul. 20, 1995

[51] Int. Cl.[6] ..... F42B 12/20

[52] U.S. Cl. ..... 102/478; 102/473; 102/492

[58] Field of Search ..... 102/473, 478, 102/489, 491, 492, 493, 494, 495, 496, 497

[56] References Cited

U.S. PATENT DOCUMENTS

| | | | |
|---|---|---|---|
| 421,313 | 2/1890 | Reynolds | 102/478 |
| 3,676,907 | 7/1972 | Magis | 102/473 |
| 3,934,511 | 1/1976 | Cordle et al. . | |
| 4,239,004 | 12/1980 | Day et al. . | |
| 4,284,007 | 8/1981 | Arnell et al. | 102/491 |
| 4,612,859 | 9/1986 | Furch et al. | 102/491 |
| 5,038,686 | 8/1991 | Zulkoski et al. | 102/496 |
| 5,191,169 | 3/1993 | Hu | 102/491 |
| 5,383,405 | 1/1995 | Everest . | |

FOREIGN PATENT DOCUMENTS

| | | | |
|---|---|---|---|
| 333573 | 11/1903 | France | 102/478 |
| 113414 | 3/1945 | Sweden | 102/478 |
| 104193 | 3/1917 | United Kingdom | 102/494 |

*Primary Examiner*—Harold J. Tudor
*Attorney, Agent, or Firm*—Gregory S. Rosenblatt

[57] ABSTRACT

A segmenting warhead projectile has a fore section integral with an aft section. A mid section is disposed between the fore section and the aft section. Up range of a target, an explosive contained within the mid section is detonated separating the fore section from the aft section. When a desired separation distance is achieved, explosives contained within the fore and aft sections detonate, fragmenting the housing of the sections. The fragmentation patterns of the two sections overlap, providing a high dispersion of fragmentation segments along the line of flight compensating for range errors.

16 Claims, 4 Drawing Sheets

SEGMENTING WARHEAD PROJECTILE

BACKGROUND OF THE INVENTION

1. Field of the Invention

This invention relates to an explosive warhead. More particularly, separation of the fore section and the aft section of the warhead prior to detonation improves the fragmentation distribution along the line of flight.

2. Description of Related Art

Conventional explosive projectiles have a cylindrical housing made from steel or another dense metal. When an explosive charge contained within the housing detonates, the housing fragments and is dispersed as a distinctive fragmentation pattern. For a cylindrical housing, up to 80% of the fragmenting mass is dispersed at a fly-off angle of approximately 90° from the direction of projectile flight with few forward and aft directed fragments.

Most of the fragment distribution is perpendicular to the direction of flight and a target slightly forward of or rearward from the detonation point will incur little damage. The conventional projectile offers poor compensation for errors in the up range and down range directions.

There exists, therefore, a need for an explosive projectile that generates a fragmentation pattern more concentrated along the direction of flight of the projectile.

SUMMARY OF THE INVENTION

Accordingly, it is an object of the invention to provide a segmenting warhead projectile that produces a fragmentation pattern concentrated along the line of flight. It is a feature of the invention that the segmenting warhead projectile has a fore section and an aft section separated by a separation chamber. Another feature of the invention is that the separation chamber detonates prior to detonation of the fore section and the aft section and that the fore section and the aft section separate by a desired amount prior to being detonated.

It is an advantage of the invention that the fragmentation pattern produced is concentrated along the line of flight increasing the distribution of fragments up range and down range of the detonation point, compensating for range errors.

In accordance with the invention, there is provided an explosive warhead. The warhead has a cylindrical body with a fore section that is integral with an aft section. A mid section is disposed between the fore section and the aft section. The fore section has a frangible first housing containing a first explosive and has a first interface with the mid section. The aft section has a frangible second housing and contains a second explosive and has a second interface with the mid section. The mid section has a frangible third housing and contains a third explosive.

In accordance with the invention, there is further provided a method for detonating an explosive warhead. This method includes the steps of:

(a) Providing a cylindrical body that has a fore section integral with an aft section with a mid section disposed therebetween. The fore section has a frangible first housing containing a first explosive and a first interface with the mid section. The aft section has a frangible second housing and contains a second explosive and has a second interface with the mid section. The mid section has a frangible third housing and contains a third explosive.

(b) Detonating the third explosive to fracture the third frangible housing and separate the fore section from the aft section.

(c) Delaying detonation of the first explosive and of the third explosive for a desired time following step (b).

The objects, features and advantages described hereinabove will become more apparent from the specification and drawings that follow.

IN THE DRAWINGS

DETAILED DESCRIPTION

Figure 1:
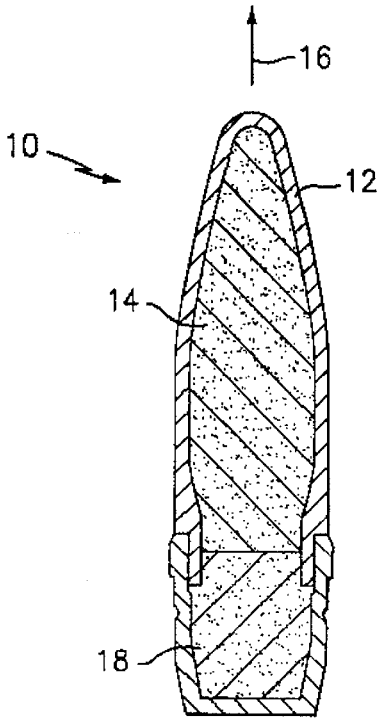
FIG. 1 (PRIOR ART)
FIG. 1 illustrates in cross-sectional representation an explosive warhead as known from the prior art.

FIG. 1 shows an explosive projectile 10 as known from the prior art. The projectile is cylindrical with a housing 12 formed from steel or another dense material. The housing 12 wall thickness is on the order of 3 millimeters. A central cavity defined by this housing 12 is filled with a suitable explosive 14. The projectile 10 travels along a line of flight 16 that is usually parallel to a major axis of the projectile 10.

Figure 2:
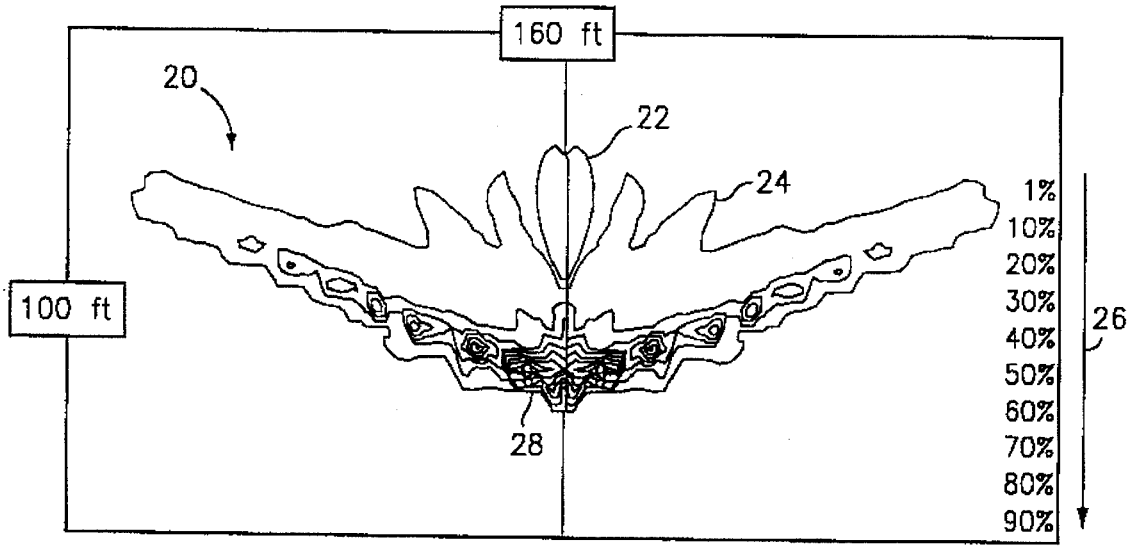
FIG. 2 (PRIOR ART)
FIG. 2 illustrates the fragmentation pattern of the explosive warhead of FIG. 1.

When a fuse 18 detonates the explosive 14, the housing 12 of the projectile 10 fragments. FIG. 2 illustrates the fragmentation pattern 22 of a 22 millimeter in diameter projectile following detonation. There is a 1% probability of incapacitating a target located within the boundary 22 of the outermost contour line. There is a 10% probability of incapacitating a target located within the boundary 24 of the next inner contour line. The probability of incapacitation increases according to the scale 26 until, within the boundary 28 of the innermost contour line, the probability is 90%.

Approximately 80% of the fragmenting mass is concentrated around a flyoff angle of approximately 90° from the line of flight 16. Only a very small percentage of the fragmentation mass is directed in the forward or aft direction along the line of flight 16. The result is poor compensation for miss errors in the up range and the down range direction. Both up range targets and down range targets incur little, if any, damage.

Figure 3:
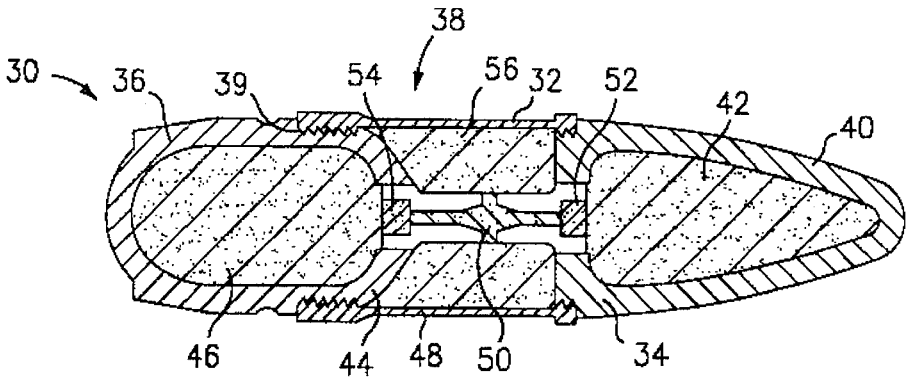
FIG. 3 illustrates in cross-sectional representation a segmenting warhead projectile in accordance with the present invention.

FIG. 3 illustrates a segmenting warhead projectile 30 in accordance with the invention. The segmenting warhead projectile 30 has a generally cylindrical body 32 made up of a fore section 34 that is integral with an aft section 36. By integral it is meant that the fore section and aft section are sufficiently bonded together to behave as a single component.

Disposed between the fore section 34 and the after section 36 is a mid section 38.

The fore section 34 has a frangible first housing 40 that is made from a dense, brittle metal such as steel. Other metals useful for the frangible first housing include tungsten, tantalum, depleted uranium and alloys thereof. The preferred steels for the frangible first housing 40 are those known as high carbon steels.

The frangible first housing has a thickness that is from about 10% to 20% of the diameter of the projectile. For a projectile having a diameter between 19 mm and 25 mm, the first housing diameter is from about 2 mm to 5 mm and preferably from about 2.5 mm to 3 mm. Contained within the frangible first housing 40 is a first explosive 42. Any explosive capable of fragmenting the frangible first housing 40 is suitable.

Suitable compositions for the first explosive include LX-14 having the composition, by weight, 95.5% of HMX (cyclotetramethylenetetranitramine) and 4.5% of a thermoplastic binder such as the polyurethane ESTANE (B. F. Goodrich Co., Cleveland, Ohio). Another suitable first explosive is RDX (cyclotrimethylenetrinitramine). LX-14 is preferred because of increased energetic capacity.

The aft section 36 has a frangible second housing 44 that is similar to the frangible first housing 40 and is independently selected from the materials specified for the frangible first housing 40. Preferably, the frangible second housing 44 is also a high carbon steel and the thickness of the frangible second housing is from about 10% to 20% of the diameter of the projectile. Preferably, for projectiles having a diameter between about 19 mm and 25 mm, the frangible second housing thickness is from about 2.5 mm to 3 mm.

Contained within the second frangible housing 44 is a second explosive 46. The second explosive 46 is independently selected from the group suitable as the first explosive 42. Preferably, the second explosive 46 is also LX-14.

The mid section 38 is disposed between the fore section 34 and aft section 36 and integrally bonded to both such as by threaded joints 39. The mid section 38 has a frangible third housing 48 that may be any readily frangible material. Suitable material for the frangible third housing 48 include a high carbon steel.

The thickness of the frangible third housing 48 is the minimum required to retain structural integrity during projectile launch, about 1.5 mm to 3 mm.

Contained within the frangible third housing 48 is a third explosive 50. The third explosive 50 is any explosive suitable to segment the frangible third housing 48. Preferred explosives include LX-14 and RDX with RDX being most preferred.

A first interface 52 facilitates communication between the third explosive 50 and the first explosive 42. It is desirable that the first explosive detonates subsequent to detonation of the third explosive 50. To provide the detonation delay, the first interface 52 contains a suitable slow burning material such as a fuse formed from an RDX base compound filled with a delay mix such as that specified by Mil.-T-23132-A, tungsten powder mixed with barium chromate, potassium perchlorate and diatomaceous earth.

A second interface 54 facilitates communication of the third explosive 50 with the second explosive 46. Since a delay in the detonation of the second explosive 46 is desired, the second interface 54 also contains a slow burning compound such as an RDX base compound filled with a delay mix.

The segmenting warhead projectile is launched from any suitable apparatus such as a grenade launcher, for example, the M-203 and Mark-19 utilized by the U.S. Armed Forces.

A fuse 56 as known from the art is actuated by any desired means to initiate detonation of the third explosive 50. One suitable fuse is torroidal shaped and wrapped around the mid section 38.

Detonation of the third explosive 50, fragments the frangible third housing 48, separating the fore section 34 from the aft section 36. The shock wave of detonation of the third explosive 50 accelerates the fore section 34 while decelerating the aft section 36, causing the sections to separate. Detonation of the third explosive 50 also ignites the material contained within the first interface 52 and within the second interface 54.

The detonation of the third explosive 50 occurs a distance up range of the intended target to compensate for the delay in detonation of the first explosive 34 and second explosive 36.

Figure 4:
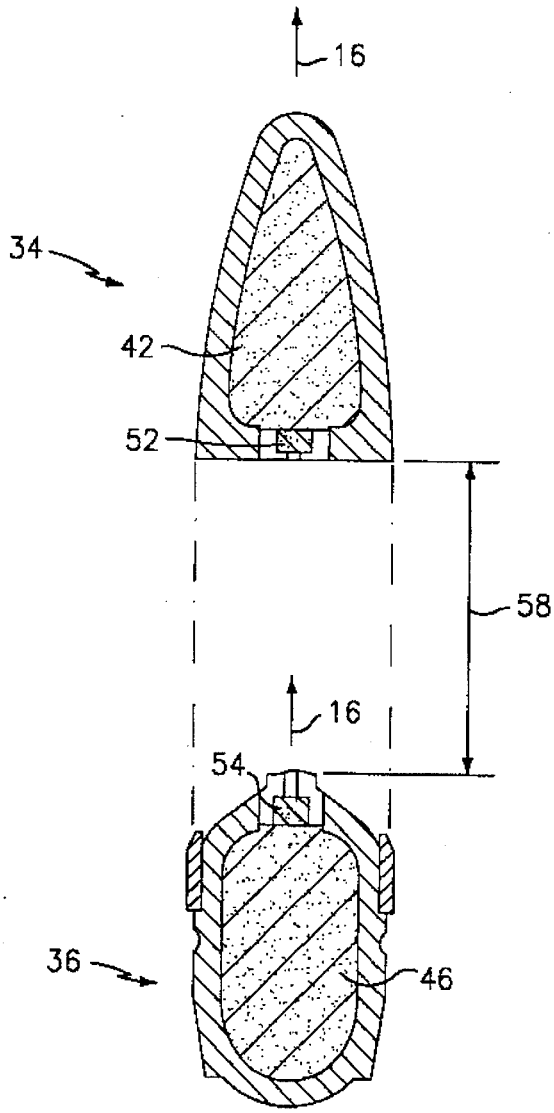
FIG. 4 illustrates in cross-sectional representation the separation of the fore section from the aft section of the segmenting warhead projectile of FIG. 3.

With reference to FIG. 4, subsequent to separation, the sections travel along the same line of flight 16 at slightly different speeds increasing the separation distance 58. Detonations of the first explosive 42 and second explosive 46 are timed, through the length of the first interface 52 and second interface 54, as well as the selection of material and quantity of material occupying the first interface 52 and the second interface 54.

The optimum separation distance 58 is that which results in two relatively spherical fragmentation patterns that slightly overlap at their adjacent edge. Since the larger the projectile, the larger the fragmentation pattern, the optimum separation distance is dependent on size of the projectiles. Typically, the separation distance 58 will be from about 0.5 meters to 10 meters and preferably from about 3 meters to 5 meters.

Figure 5:
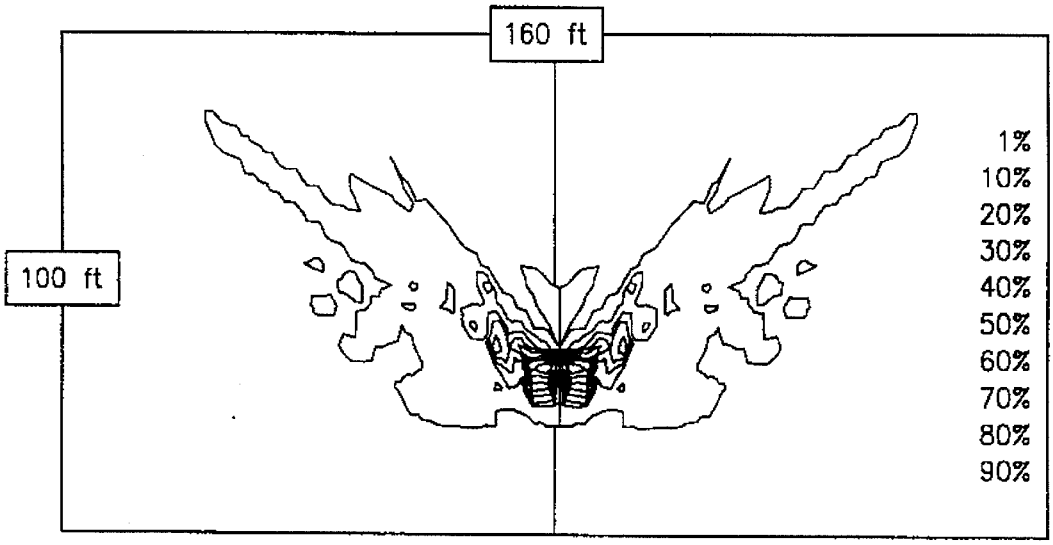
FIG. 5 illustrates the fragmentation pattern of the fore section of the segmenting warhead projectile of FIG. 3.
Figure 6:
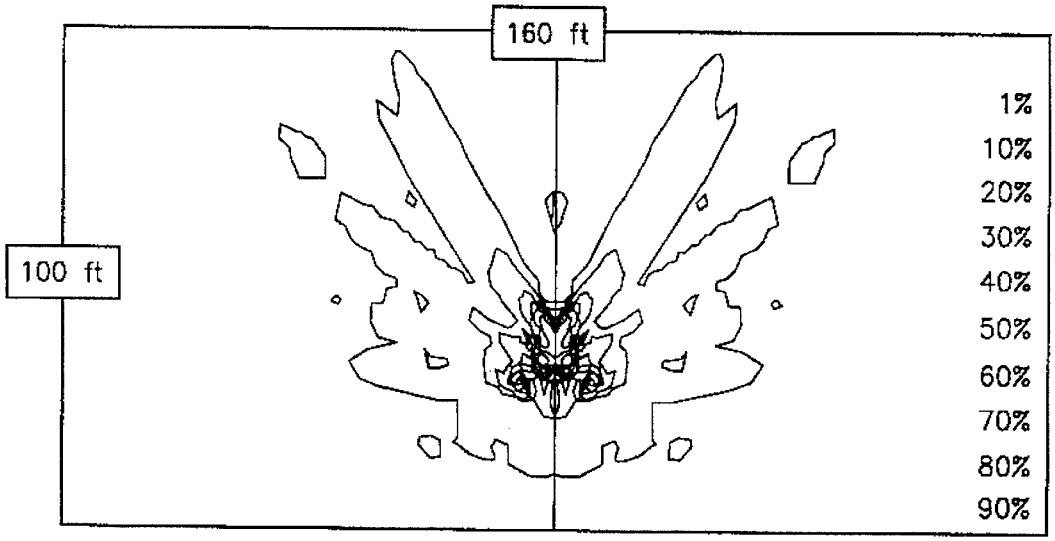
FIG. 6 illustrates the fragmentation pattern of the aft section of the segmenting warhead projectile of FIG. 3.

FIG. 5 illustrates the fragmentation pattern from the fore section and FIG. 6 illustrates the fragmentation pattern from the aft section for a projectile 30 as illustrated in FIG. 3. The projectile has diameter of 22 mm and the boundary line contours represent the probability of incapacitation as described above.

The warhead is traveling at a nominal speed of about 1000 feet per second. The time between detonation of the third explosive and detonation of the first and second explosives is from about 50 milliseconds to 200 ms and preferably from about 100 ms to about 150 ms.

The optimal fragmentation pattern along the line of flight is achieved when the fore section and the aft section both have a shape approximating a sphere. Preferably, the ratio of the length of the fore section and of the aft section along the line of flight to the diameter of the sections perpendicular to the line of flight is from about 0.5:1 to 2:1 and preferably from about 0.9:1 to 1.1:1.

Figure 7:
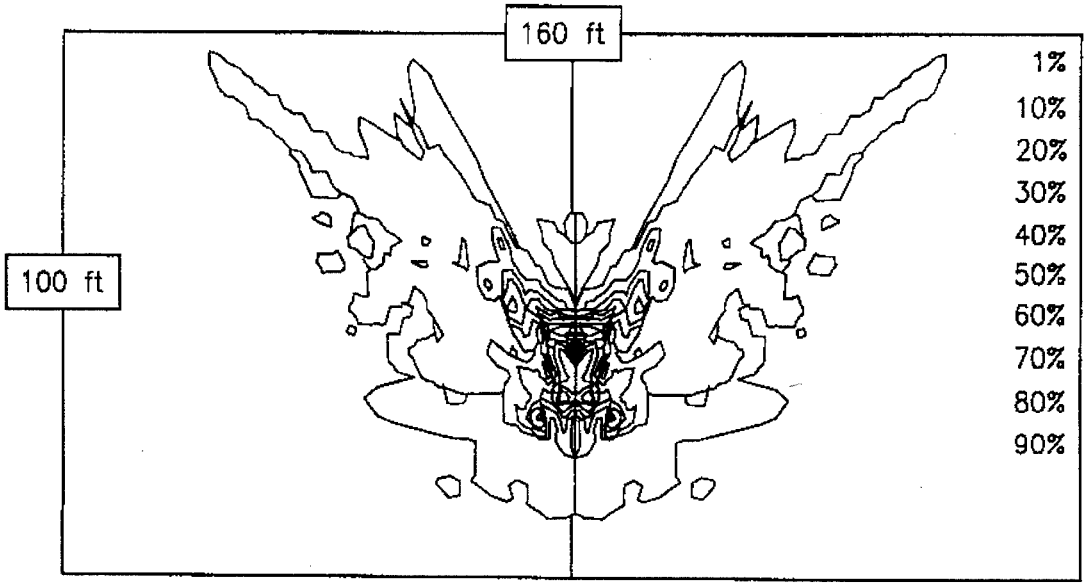
FIG. 7 illustrates the overlapping fragmentation patterns of the fore and aft sections of the segmenting warhead projectile of FIG. 3.

FIG. 7 shows the fragmentation pattern achieved with a 22 mm diameter segmenting warhead projectile in accordance with the invention. The overlapping fore section and aft section fragmentation patterns were achieved with 5 meters of separation at detonation.

A significant portion of the fragmentation pattern is along the line of flight and up range targets and down range targets are both within the high probability of incapacitation fragmentation boundary line contours, illustrating the significantly more effective projectile design for bursting munition achieved with the warhead of the invention.

It is apparent that there has been provided in accordance with this invention a segmenting warhead projectile that fully satisfies the objects, features and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. An explosive warhead, comprising:

a cylindrical body having a fore section integral with an aft section with a mid-section disposed therebetween;

said fore section having a frangible first housing containing a first explosive and a first interface with said mid-section, said first interface filled with a first delay mix;

said aft section having a frangible second housing and containing a second explosive and having a second interface with said mid-section, said second interface filled with a second delay mix;

said mid-section having a frangible third housing and containing a third explosive; and a fuse disposed within said frangible third housing to initiate detonation of said third explosive wherein said first interface and said second interface are both of a length effective to contain a quantity of first and second respective delay mixes that is effective to delay detonation of said respective first and second explosives for from 50 milliseconds to 200 milliseconds after detonation of said third explosive, thereby generating relatively spherical fragmentation patterns that overlap.

2. The warhead of claim 1 wherein said fore section and said aft section independently each have a housing thickness of from about 10% to 20% of the diameter of said warhead.

3. The warhead of claim 2 wherein said first housing and said second housing are independently each selected from the group consisting of iron, steel, tungsten, tantalum, depleted uranium and alloys thereof.

4. The warhead of claim 3 wherein the ratios of the length to the diameter of said fore section and of said aft section are, independently, from about 0.5:1 to about 1.1:1.

5. The warhead of claim 4 wherein said first housing, said second housing and said third housing are all high carbon steels.

6. The warhead of claim 4 wherein first and second threaded joints bond said mid section to said fore section and to said aft section, respectively.

7. The warhead of claim 4 wherein said delay mix is tungsten powder combined with barium chromate, potassium perchlorate and diatomaceous earth.

8. An explosive warhead launched from a grenade launcher, comprising:

a cylindrical body having a diameter of from about 19 mm to 25 mm and a fore section integral with an aft section with a mid-section disposed therebetween;

said fore section having a high carbon steel first housing with a thickness of from about 2.5 mm to about 3 mm and containing a first explosive and a first interface with said mid-section, said first interface filled with a first delay mix;

said aft section having a high carbon steel second housing with a thickness of from about 2.5 mm to about 3 mm and containing a second explosive and having a second interface with said mid-section, said second interface filled with a second delay mix;

said mid-section having a high carbon steel third housing with a thickness of from about 1.5 mm to 3 mm and containing a third explosive; and a fuse disposed within said mid section to initiate detonation of said third explosive wherein said first interface and said second interface are both of a length effective to contain a quantity of first and second respective delay mixes that is effective to delay detonation of said first and second respective explosives for from 50 milliseconds to 200 milliseconds after detonation of said third explosive, thereby generating relatively spherical fragmentation patterns that overlap.

9. The warhead of claim 8 wherein first and second threaded joints bond said mid-section to said fore section and to said aft section, respectively.

10. The warhead of claim 8 wherein the ratios of the length to the diameter of said fore section and of said aft section are, independently, from about 0.5:1 to about 1.1:1.

11. The warhead of claim 10 wherein said first explosive and said second explosive are LX-14 and said third explosive is RDX.

12. The warhead of claim 11 wherein said delay mix is tungsten powder combined with barium chromate, potassium perchlorate and diatomaceous earth.

13. The warhead of claim 12 including a detonator mounted to said third housing.

14. A method for detonating an explosive warhead, comprising:

a) providing a cylindrical body having a fore section integral with an aft section with a mid-section disposed therebetween, said fore section having a frangible first housing containing a first explosive and a first interface with said mid-section, filling said first interface with a first delay mix, said aft section having a frangible second housing and containing a second explosive and having a second interface with said mid-section, filling said second interface with a second delay mix, and said mid-section having a frangible third housing and containing a third explosive, said mid-section having a fuse disposed therein;

b) detonating said third explosive by actuation of said fuse thereby fracturing said third frangible housing and separating said fore section from said aft section while igniting said first delay mix and said second delay mix; and c) delaying detonation of said first explosive and said second explosive for from about 50 milliseconds to 200 milliseconds after step (b), thereby generating relatively spherical fragmentation patterns that overlap.

15. The method of claim 14 wherein step (c) occurs when said fore section is separated from said aft section by a distance of from about 0.5 meter to 10 meters.

16. The method of claim 15 wherein the ratios of the length to the diameter of said fore section and of said aft section are, independently, selected to be from about 0.5:1 to about 1.1:1.

* * * * *